US008181589B2

(12) United States Patent
Petersen et al.

(10) Patent No.: US 8,181,589 B2
(45) Date of Patent: May 22, 2012

(54) GRAVITY ANCHOR

(75) Inventors: Jim B. Petersen, Ahwahnee, CA (US); Chellakat Satyaraj Joe-Joe, Cochin (IN)

(73) Assignee: J. Ray McDermott, S.A., Houston, TX (US)

( * ) Notice: Subject to any disclaimer, the term of this patent is extended or adjusted under 35 U.S.C. 154(b) by 163 days.

(21) Appl. No.: 12/605,454

(22) Filed: Oct. 26, 2009

(65) Prior Publication Data

US 2011/0094432 A1 Apr. 28, 2011

(51) Int. Cl.
*B63B 21/24* (2006.01)

(52) U.S. Cl. ..... 114/294

(58) Field of Classification Search ..... 114/293–296, 114/300; 405/172, 224; 52/155, 166
See application file for complete search history.

(56) References Cited

U.S. PATENT DOCUMENTS

| | | | | | |
|---|---|---|---|---|---|
| 2,735,394 | A * | 2/1956 | Walpole | 114/294 |
| 4,224,892 | A * | 9/1980 | Sandberg | 114/294 |
| 4,776,140 | A * | 10/1988 | Wight et al. | 52/125.5 |
| 4,951,592 | A * | 8/1990 | Barongan | 114/294 |
| 5,899,165 | A * | 5/1999 | Komura et al. | 114/294 |
| 2005/0000170 | A1 * | 1/2005 | DiDomenico | 52/155 |

* cited by examiner

*Primary Examiner* — Edwin Swinehart
(74) *Attorney, Agent, or Firm* — D. Neil LaHaye

(57) ABSTRACT

A gravity anchor that includes one or more anchor units. The units are designed to be rotationally linked together so that multiple units can be used to provide the required weight. The units are designed for ease of handling on the vessel and to control the rotation of the units relative to each other to insure proper orientation on the seafloor. The units are designed to help them dig into the sea bed and enhance the drag and holding power.

1 Claim, 2 Drawing Sheets

GRAVITY ANCHOR

FIELD AND BACKGROUND OF INVENTION

The invention is related to anchors and more particularly to gravity anchors that are used to moor barges and vessels in place.

Floating marine vessels and barges are subjected to external loads from the environment and from operation of the vessels. Environmental loads are mainly from waves, wind, and current. Operation loads originate from the function, such as towing, laying of submarine pipelines, etc. It is essential to hold the vessel at the desired designated station (station keeping) in order to execute the work offshore. "Station keeping" of the vessel is achieved by two methods—mooring by marine anchors and by dynamic positioning means such as thrusters.

Mooring by marine anchors is typically the simplest way of station keeping a vessel. Various types of anchors have been used for this purpose. One type is the "gravity anchor" or the "deadweight anchor".

Anchor handling tug boats (AHT's) are the typical vessels/boats used to deploy and retrieve anchors.

The gravity anchor provides holding power from the submerged weight of the anchor.

The holding power of the gravity anchor is proportional to its weight. The higher the weight, the higher the holding power of the anchor. However, the higher the weight of the gravity anchors, the more difficult it becomes to handle it offshore. Often, the tugs (AHT's) may not have the required crane capacity to handle these heavy gravity anchors. Due to the size of the vessels involved in offshore oilfield work, gravity anchors can each easily weigh several tons in order to provide the necessary holding power.

The disadvantage of the need for AHT's is compounded in shallow water operations where the draft of the AHT must be limited. This tends to contradict the crane capacity required on the AHT to effectively handle the anchors.

Because conventional gravity anchors must be lifted by crane, re-deployment becomes a time consuming operation. Deployment of gravity anchors by and storage on the vessel presents issues related to storage space due to the size and placement of multiple anchors and the potential damage that the anchors can cause to the vessel during deployment and retrieval of the anchors.

SUMMARY OF INVENTION

The present invention is drawn to a gravity anchor that includes one or more units. The units are designed to be rotationally linked together so that multiple units can be used to provide the required weight. The units are designed for ease of handling on the vessel and to control the rotation of the units relative to each other to insure proper orientation on the seafloor. The units are designed to help them dig into the sea bed and enhance the drag and holding power.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
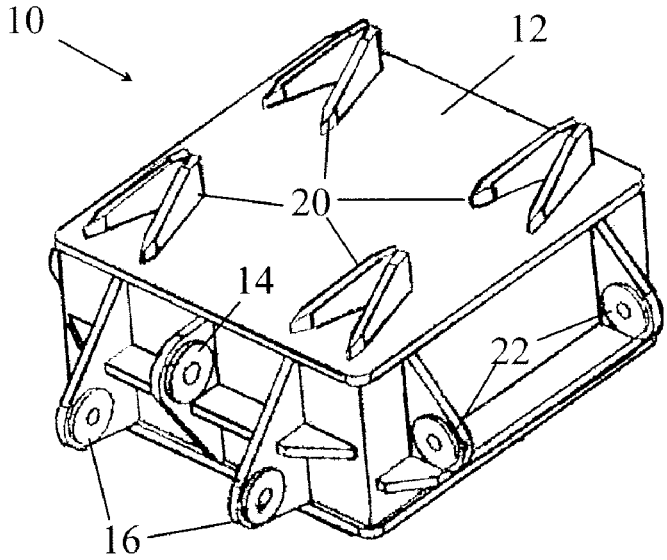
FIG. 1 is a perspective view of one gravity anchor unit.

A single anchor unit 10 of the gravity anchor is illustrated in FIG. 1. The single unit will be referred to as the anchor unit for ease of reference. It should be understood that one or more anchor units 10 may be used in combination to provide the necessary weight and holding power in accordance with the requirements of each specific situation.

Figure 8:
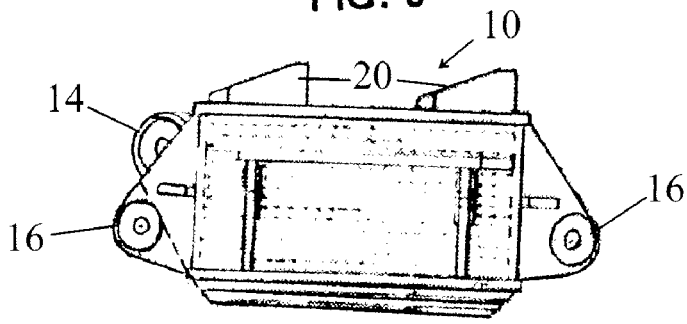
FIG. 8 is a side elevation view of the anchor unit in FIG. 1.

As seen in FIGS. 1 and 8, an anchor unit 10 has a top, a bottom, and four sides and is generally comprised of dead weight 12, main padeye 14, hinge padeyes 16, spikes 20, and handling padeyes 22.

Dead weight 12—The majority of the anchor unit's weight is present in the deadweight 12. It may be made completely of steel, a steel enclosure filled with lead weight, or a steel enclosure filled with concrete. Depending on the vessel, water depth, soil conditions, etc., each anchor unit 10 is envisioned to weigh in the range of 10 to 30 metric tons.

The main padeye 14 serves as the attachment point for the mooring line from the floating vessel which the anchor units hold in position.

The hinge padeyes 16 are provided at opposite ends of each anchor unit 10 (best seen in FIG. 8) and are used to link multiple anchor units in series by inserting a pin not shown through the hinge padeyes 16 of adjacent anchor units. The hinge padeyes 16 are complementary spaced at opposite sides of the anchor unit 10 to allow connection. The pins are secured in place through the padeyes and allow rotation of the anchor units relative to each other. It can be seen that the hinge padeyes 16 are not centered along the thickness of the body of the anchor unit 10. The brackets for the hinge padeyes cause the padeyes to be offset away from the bottom face with the spikes 20. This offset, coupled with the shape of the brackets, allows different degrees of relative rotation between linked anchor units in opposite directions, approximately ninety degrees in one direction and only approximately fifteen degrees in the opposite direction. The importance of this built in rotational control is explained below.

Spikes 20 are provided on the surface of the anchor unit 10 that will sit on the sea floor. The spikes 20 help to dig the anchor unit 10 into the sea floor and enhance the drag and holding power of the anchor unit 10. The spikes 20 extend above the surface of the anchor unit and may be of any suitable shape. As seen in FIG. 1, the spikes 20 in this embodiment are essentially V-shaped.

At least one set of handling padeyes 22 are located on one side of the anchor unit 10 and preferably a second set also on the opposite side of the anchor unit 10 for ease of handling. The handling padeyes are connected to a crane line and used to position and move the anchor unit 10 as required during operations.

Figure 2:
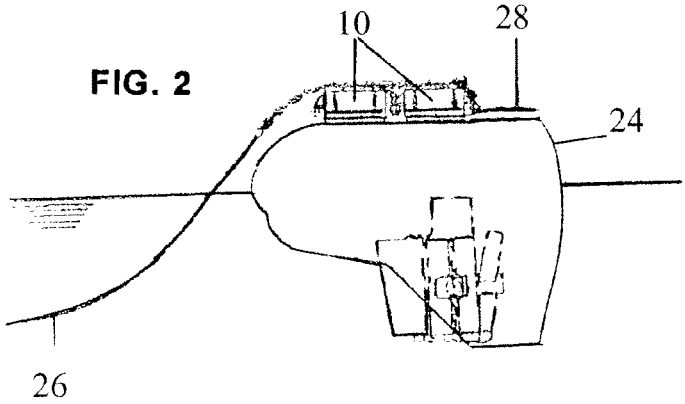
FIG. 2-6 illustrate the installation sequence of the gravity anchor units from an anchor handling tug.

In operation, the required number of anchor units 10 are rotationally linked together on the anchor handling tug (AHT) 24 as seen in FIG. 2. The mooring line 26 from the vessel or barge (not shown) to be kept on station is attached to the main padeye 14. It is important to note that the anchor unit 10 with the attached mooring line 26 is positioned farthest from the end of the vessel from which the gravity anchor 10 will be deployed such that the mooring line is draped over all of the anchor units 10 to the nearest end of the AHT 24.

A pendant line 28 has one end attached to the hinge padeyes 16 of the same anchor unit 10 attached to the mooring line and the other end engaged with a winch not shown on the AHT 24.

Figure 3:
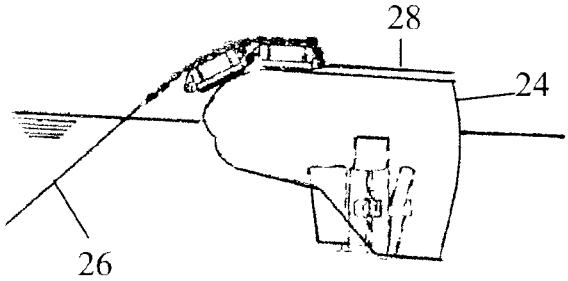

As seen in FIG. 3, the mooring line 26 is tensioned to pull the anchor units 10 off the deck of the AHT 24. At the same time, the pendant line 28 is released in a controlled manner with the winch to control movement of the anchor units 10 and the descent to the sea floor.

Figure 4:
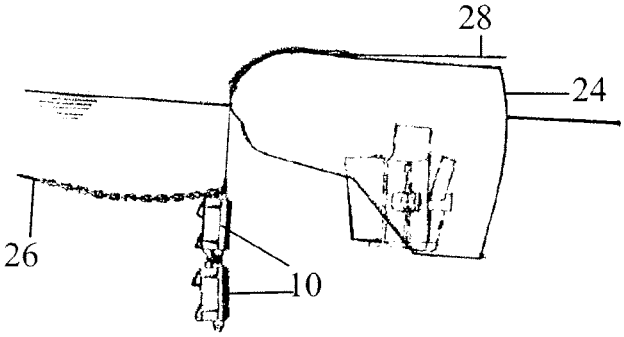

FIG. 4 illustrates the anchor units 10 completely off the deck of the AHT 24 and being supported by the pendant line 28.

Figure 5:
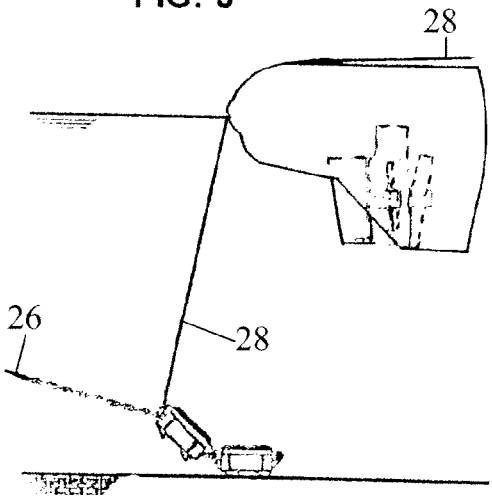

FIG. 5 illustrates the contact of the second anchor unit 10 with the sea floor and the effect of the specially designed hinge padeyes 16 and their brackets. The curved bracket at the end of the second anchor unit 10 helps to cause the bottom of the anchor unit 10 to rotate toward the sea floor such that the spikes 20 contact the sea floor. The hinge padeyes 16 between the connected anchor units help prevent the first anchor unit 10, attached to the pendant line 28 and the mooring line 26, from rotating toward the second anchor unit and landing on it. Tension on the mooring line 26 can also be applied to insure the proper rotation and orientation in the event the surface of the sea floor is uneven.

Figure 6:
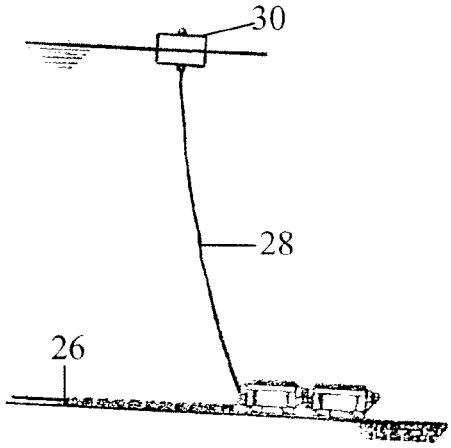

FIG. 6 illustrates the anchor units 10 installed on the sea floor with the spikes 20 in contact with the seafloor and the pendant line 28 removed from the AHT and attached to a buoy 30 to mark the location of the anchor units 10.

Figure 7:
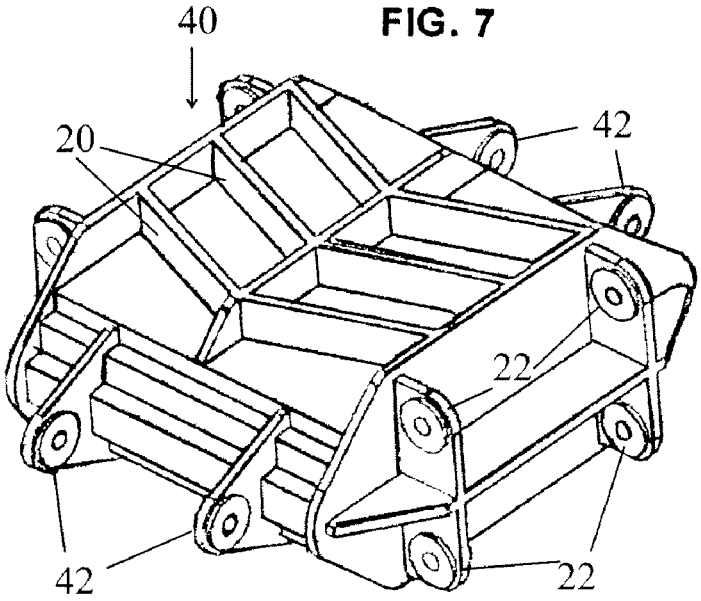
FIG. 7 is a perspective view of an alternate arrangement of an anchor unit.

FIG. 7 illustrates an alternate embodiment of the invention. Anchor unit 40 has spikes 20 installed on the top and bottom. The main and hinge padeyes are combined together to form a single set of main and hinge padeyes 42. Two sets of handling padeyes 22 may also be provided on each side. The installation process is the same as described above.

The invention provides several advantages.

Ease of transport—The ability to use multiple anchor units to divide the weight makes for easier transport and reduces the crane capacity on the vessels involved in the work.

Ease of assembly—Depending on the requirements, multiple units can be linked together to obtain the desired weight. Thus, the utilization of anchor units can be greatly increased.

Ease of deployment and retrieval—The multi unit and rotating design provides for easy installation and retrieval over the stern of the anchor handling tug by use of the main winch on the tug.

Quick operation—Because vertical lifting of the anchors using a crane is not necessary, the time required for deploying and relocating the anchors should be much shorter than that of a conventional gravity anchor.

Safety—The absence of crane lifting operations improves safety. Also, during the re-deploying stage of the anchors they can be stored on the deck of a tug boat, thereby reducing the risk of handling over the sub-sea assets.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed as invention is:

1. A method for installing a gravity anchor on the sea floor from a vessel having a winch, without the use of a crane, comprising the steps;

a. providing two separate anchor units that are rotationally linked together, for limited rotation, in series on the deck of the vessel;

b. attaching a mooring line to the anchor unit farthest from the end of the vessel from which the gravity anchor will be deployed;

c. attaching a line from the winch on the vessel to the same anchor unit as the mooring line;

d. pulling the gravity anchor off the deck of the vessel with the mooring line and using the line from the winch on the vessel to control the descent of the anchor units to the sea floor; and e. disconnecting the winch line from the winch after the gravity anchor is installed on the sea floor and attaching the winch line to a buoy.

* * * * *